US005083762A

United States Patent [19]

Yoshizuka et al.

[11] Patent Number: 5,083,762

[45] Date of Patent: Jan. 28, 1992

[54] UP-AND-DOWN TYPE PAPER FEEDING DEVICE

[75] Inventors: Ken Yoshizuka, Nagaokakyo; Takahiro Wakikaido, Yao; Kazuya Akura, Sakai, all of Japan

[73] Assignee: Mita Industrial Co., Ltd., Osaka, Japan

[21] Appl. No.: 433,197

[22] Filed: Nov. 8, 1989

[30] Foreign Application Priority Data

Nov. 19, 1988 [JP] Japan ..... 63-293232
Nov. 19, 1988 [JP] Japan ..... 63-293233

[51] Int. Cl.[5] ..... B65H 3/44

[52] U.S. Cl. ..... 271/9; 271/110; 271/152

[58] Field of Search ..... 271/9, 110, 152, 171; 355/309

[56] References Cited

U.S. PATENT DOCUMENTS 3,820,777 6/1974 Reehil ..... 355/309 X
3,947,015 3/1976 Funk et al. ..... 271/9
4,660,820 4/1987 Shino et al. ..... 271/9
4,770,403 9/1988 Katsumata et al. ..... 271/9
4,879,575 11/1989 Maruta et al. ..... 271/9 X

FOREIGN PATENT DOCUMENTS 0199735 12/1982 Japan .
0031833 2/1983 Japan ..... 271/9
0114241 7/1984 Japan ..... 271/9
0052439 3/1985 Japan ..... 271/9
0206749 9/1986 Japan ..... 271/110
0136442 6/1987 Japan ..... 271/9
0071035 3/1988 Japan ..... 271/110

*Primary Examiner*—Robert P. Olszewski
*Assistant Examiner*—James R. Bidwell
*Attorney, Agent, or Firm*—Antonelli, Terry Stout & Kraus

[57] ABSTRACT

When a main body of an image forming apparatus is operated so that an image formation mode is set, a signal for determining which of several up-and-down type paper feeding devices is selected is applied from the main body of the image forming apparatus. In the selected paper feeding device, a selection signal detector determines that this selection signal is applied. If a paper detector determines that there are copy sheets whose number is at least a predetermined number, the paper deck is automatically raised by an up-and-down mechanism, even if the paper deck is in the lowered position. Even in the case where no up-and-down type paper feeding device is selected, if a timer measures time previously set, the paper deck may be automatically raised to a position where copy sheets can be fed. The up-and-down type paper feeding device according to the present invention has been constructed as described above and thus, an operator need not perform any operation so as to raise the paper deck from the lowered state. Consequently, there is provided an up-and-down type paper feeding device having good operability and capable of quickly and smoothly feeding copy sheets.

7 Claims, 5 Drawing Sheets

UP-AND-DOWN TYPE PAPER FEEDING DEVICE

BACKGROUND OF THE INVENTION

The present invention relates to paper feeding devices for an image forming apparatus such as an electrophotographic copying apparatus, a printer, a printing machine, and the like.

In an electrophotographic copying apparatus, an up-and-down type paper feeding device, referred to as a paper deck, is known (see, for example, Japanese Patent Laid-Open Gazette No. 199735/1982). This kind of up-and-down type paper feeding device comprises a paper deck on which copy sheets are disposed and an up-and-down mechanism. When the paper deck is raised, the copy sheets disposed thereon can be fed. When the paper deck is lowered, however, the copy sheets can not be fed.

In order to raise the paper deck from the lowered state to a position where copy sheets can be fed, it is necessary to perform some operation, for example, to depress a rise command button or to insert the paper deck again after it has been temporarily pulled out.

More specifically, in a conventional up-and-down type paper feeding device, an operator must perform some operation so as to raise the paper deck from the lowered state.

Accordingly, the conventional up-and-down type paper feeding device has the following disadvantage. In a case where it is desired to rapidly make copies, if the paper deck is lowered, making of copies can not be started until the paper deck is raised by a predetermined operation. In addition, a relatively long time is required for the paper deck to be raised to a position where copy sheets can be fed.

Such a situation is frequently formed in, for example, an electrophotographic copying apparatus comprising a plurality of paper decks. The reason for this is that the following operation error is liable to occur.

If copy sheets of A4 size are disposed on a first paper deck and copy sheets of B5 size are disposed on a second paper deck, and the copy sheets of A4 size have run out, an operator who desires to make copies on copy sheets of A4 size must lower the first paper deck so as to add copy sheets of A4 size. In this situation, the operator may, in some cases, find that the second paper deck was erroneously lowered and so must lower the first paper deck again to supply copy sheets of A4 size and then raise the first paper deck to start the making of copies. In such a case, the operator, in many cases, may forget to raise the second paper deck which was erroneously lowered or may not raise the same. Accordingly, the next operator, who desires to make copies on the copy sheets of B5 size, must raise the lowered second paper deck by a button operation so that making of copies can not be started until the second paper deck is raised.

SUMMARY OF THE INVENTION

An object of the present invention is to provide an up-and-down type paper feeding device having good operability and adapted to automatically raise a paper deck on the basis of constant conditions even if the paper deck is in the lowered state mainly due to an error of an operator.

In order to attain the above described object, a first invention provides an up-and-down type paper feeding device comprising a paper deck and an up-and-down mechanism, characterized by paper detecting means for determining that the number of copy sheets disposed on the paper deck is at least a predetermined number selection signal detecting means for determing that a selection signal for selecting paper feeding from the up-and-down type paper feeding device is applied from the main body of an image forming apparatus, and control means responsive to outputs of both the paper detecting means and the selection signal detecting means for driving the up-and-down mechanism such that the paper deck enters a state where the copy sheets disposed thereon can be fed.

When the main body of the image forming apparatus is operated so that an image formation mode is set, a signal for determining which of up-and-down type paper feeding devices is selected is applied from the main body of the image forming apparatus. In the selected up-and-down type paper feeding device, the selection signal detecting means determines that this selection signal is applied. If the paper detecting means determines that there are copy sheets whose number is at least the predetermined number, the control means allows the copy sheets contained in the up-and-down type paper feeding device to be fed. More specifically, even if the paper deck is in the lowered position, the paper deck is automatically raised by the up-and-down mechanism.

In order to attain the above described object, a second invention provides an up-and-down type paper feeding device characterized by deck down detecting means for determining that a paper deck is in the lowered position, paper detecting means for determining that the number of copy sheets disposed on the above paper deck is at least a predetermined number, timer means initiated in response to outputs of both the deck down detecting means and the paper detecting means, and control means for driving the up-and-down mechanism on the basis of elapse of time previously determined by the timer means so as to raise the paper deck.

If the paper deck is in the lowered position, an output is provided from the deck down detecting means. In addition, if there are copy sheets whose number is at least the predetermined number an output is provided from the paper detecting means. The timer means starts in response to the output of both the detecting means. When the timer means measures the time previously determined, the up-and-down mechanism is controlled by the control means, so that the paper deck can be raised to a position where the copy sheets can be fed.

The up-and-down type paper feeding device according to the present invention has been constructed as described above. Accordingly, the operator need not perform any operation so as to raise the paper deck from the lowered state. Consequently, there is provided an up-and-down paper feeding device having good operability, and capable of quickly and smoothly feeding copy sheets.

The foregoing and other advantages of the present invention will become more apparent from the following description when taken in conjunction with the accompanying drawings.

DECRIPTION OF THE PREFERRED EMBODIMENTS

Figure 1:
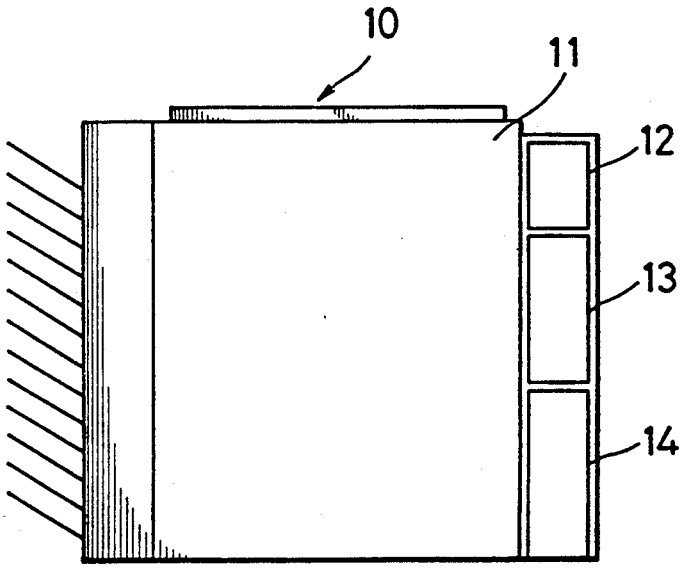
FIG. 1 is a front elevation of an electrophotographic copying apparatus according to an embodiment of the present invention.

FIG. 1 is a fron elevation of an electrophotographic copying apparatus 10 provided with up-and-down type paper feeding devices according to an embodiment of the present invention. The electrophotographic copying apparatus 10 has three up-and-down type paper feeding devices 12, 13 and 14 in three stages on upper, middle and lower areas of the side surface of its main body 11. Any one of the up-and-down type paper feeding devices 12, 13 and 14 is selected at the time of forming an image, copy sheets contained therein being sequentially supplied to the main body 11.

Figure 2:
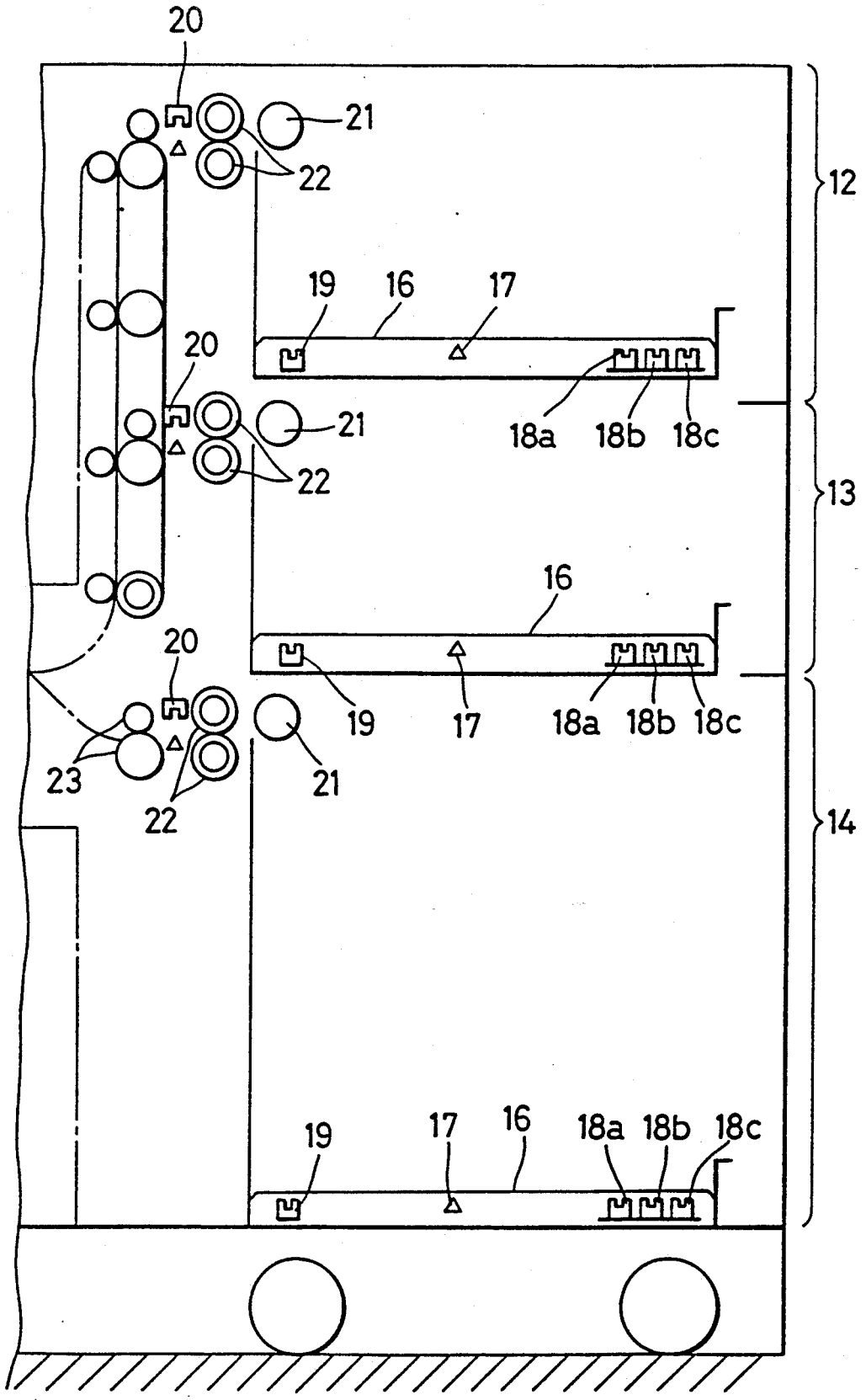
FIg. 2 is an illustration of up-and-down type paper feeding devices provided in the above described electrophotographic copying apparatus.

FIg. 2 is an illustration for explaining structures and operations of the up-and-down type paper feeding devices 12, 13 and 14 shown in FIG. 1.

The up-and-down type paper feeding device 14 in the lowest stage will be described by way of example. The up-and-down type paper feeding device 14 including a paper deck 16 on which copy sheets are disposed. The paper deck 16 is raised and lowered by an up-and-down mechanism (not shown) comprising a combination of a motor, a pully and a belt. The paper deck 16 comprises a paper detecting switch 17 which is turned on when one or more copy sheets are disposed, on deck 16 and size detecting switches 18*a*, 18*b* and 18*c* for detecting the size of the copy sheets disposed on deck 16.

Furthermore, the up-and-down type paper feeding device 14 includes a deck down detecting switch 19 and a deck up detecting switch 20. When the paper deck 16 is lowered to the lowered position where copy sheets can be supplied by pulling down the paper deck 16 on this side, the deck down detecting switch 19 is turned on. Contrary to this, when the paper deck 16 is raised to a position where copy sheets can be fed, the deck up detecting switch 20 is turned on.

Additionally, the up-and-down type paper feeding device 14 includes a take out roller 21 for taking out the copy sheets on the paper deck 16 one at a time at the time of paper feeding, and pairs of feed rollers 22 and 23 for sending the copy sheets taken out to the main body 11 of the electrophotographic copying apparatus 10. The pair of feed rollers 23 also functions to return the copy sheets taken out from the paper deck 16 and interposed between the pair of rollers 23 to the paper deck 16 before the paper deck 16 is lowered.

The other two up-and-down type paper feeding devices 12 and 13 have the same structure as that of the up-and-down type paper feeding device 14. Accordingly, the same reference numerals are assigned to corresponding portions, and the specific description thereof is not repeated.

Figure 3:
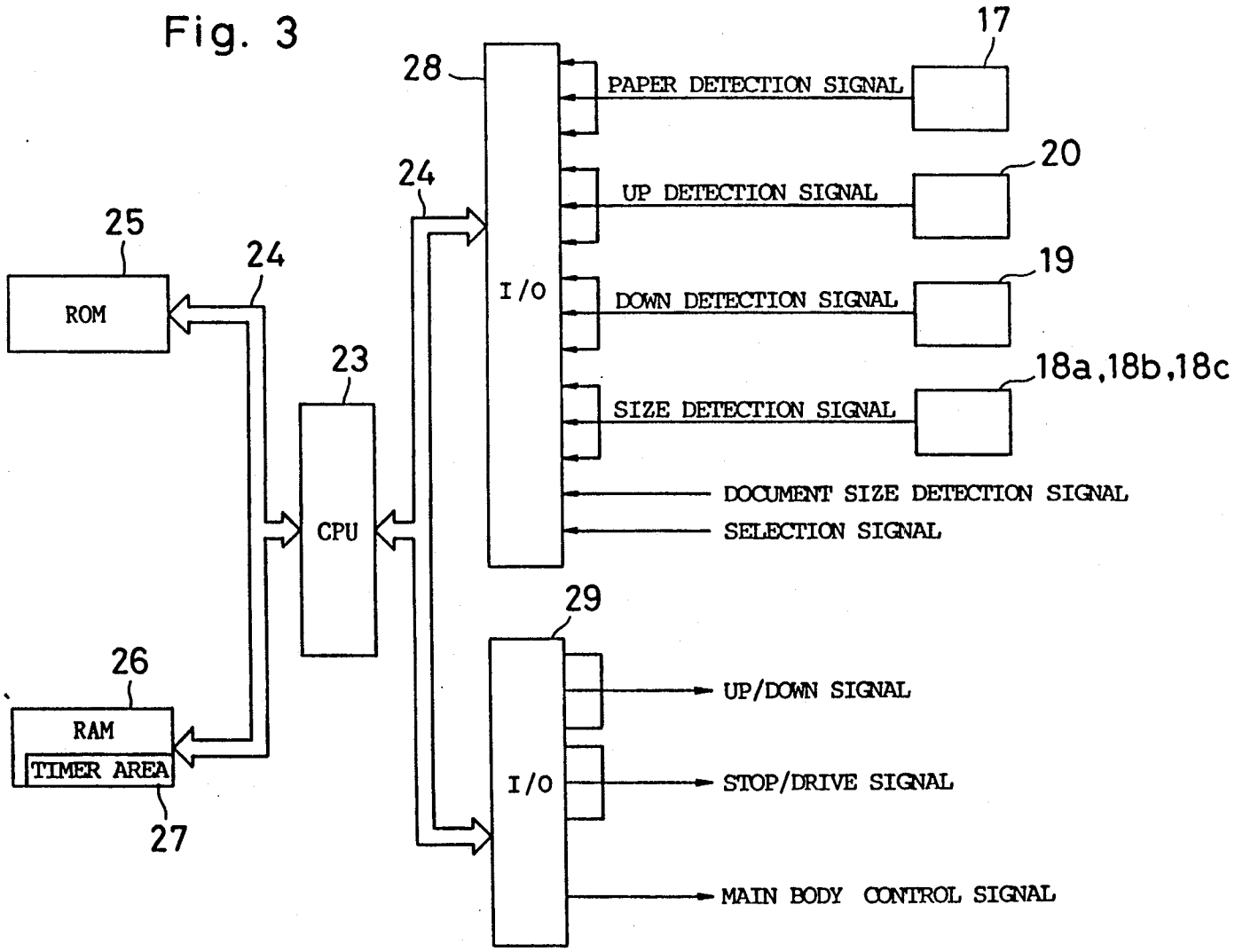
FIG. 3 is a block diagram illustrating a control circuit of the electrophotographic copying apparatus.

FIG. 3 is a block diagram illustrating a control circuit for controlling the up-and-down type paper feeding device 12, 13 and 14. The control circuit is centered with respect to a CPU (central processing unit) 23 which is the operation and control center. A ROM (read-only memory) 25 storing an operation program of the CPU 23 and a readable/writable RAM (random access memory) 26 are connected to the CPU 23 through a bus 24. The RAM 26 has a timer area 27 required to measure time. In addition, the CPU 23 controls not only the up-and-down type paper feeding devices 12, 13 and 14 but also driving of the main body 11 of the electrophotographic copying apparatus 10. Input/output interfaces 28 and 29 are connected to the CPU 23 through the bus 24. Signals from the paper detecting switch 17, the size detecting switches 18*a*, 18*b* and 18*c*, the deck down detecting switch 19 and the deck up detecting switch 20, respectively provided on the up-and-down type paper feeding devices 12, 13 and 14, are applied to the CPU 23 through the input/output interface 28.

Furthermore, a document size detection signal from the main body 11 of the electrophotographic copying apparatus 10 and a selection signal for determining which of the up-and-down type paper feeding devices 12, 13 and 14 feeds copy sheets is to be applied to the input/output interface 28.

On the other hand, a stop/drive signal of an up-and-down motor and an up/down signal for indicating the up and down direction are applied to up-and-down mechanisms (not shown) of the up-and-down type paper feeding devices 12, 13 and 14 from the CPU 23 through the input/output interface 29. In addition, a main body control signal is applied through input/output interface 29 to the main body 11 of the electrophotographic copying apparatus 10.

Figure 4:
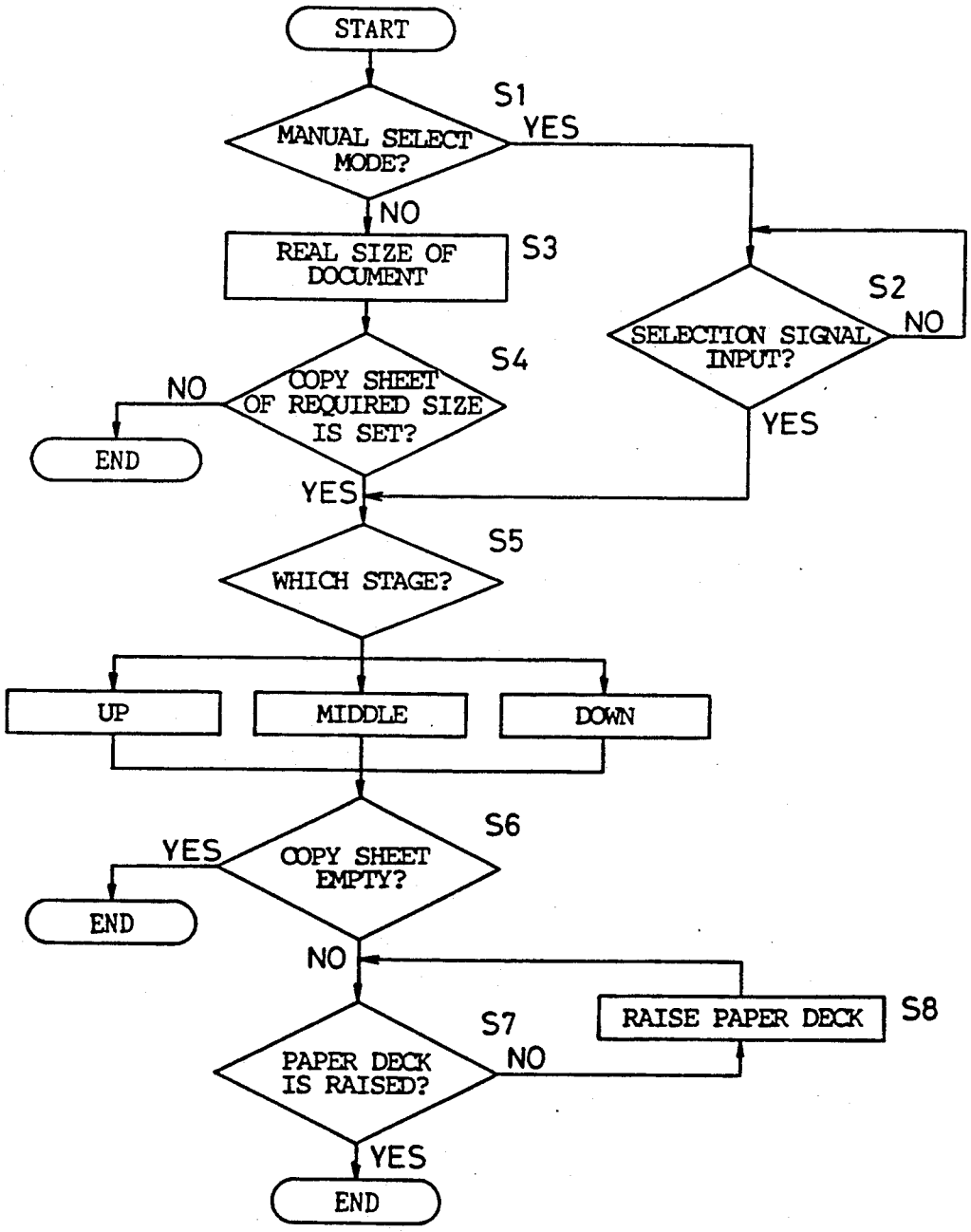
FIg. 4 is a flow chart showing a control operation of an up-and-down type paper feeding device according to an embodiment of the present invention.

FIG. 4 is a flow chart for explaining a first operation of the control circuit shown in FIG. 3. This first operation corresponds to a first embodiment of the present invention.

Referring now to FIGS. 4 and 3, description is made with respect to the control operation of this electrophotographic copying apparatus 10, particularly for the up-and-down type paper feeding devices 12, 13 and 14.

When the main body 11 of the electrophotographic copying apparatus 10 is in the manual select mode for making a manual selection as to which of the up-and-down type paper feeding devices 12, 13 and 14 feeds copy sheets to the main body 11 of the electrophotographic copying apparatus 10 (step S1), the CPU 23 waits input of the selection signal (step S2).

On the other hand, when the main body 11 of the electrophotographic copying apparatus 10 is not in the manual select mode, the CPU 23 controls the main body 11 of the electrophotographic copying apparatus 10 to read the size of a document (step S3). It is determined whether or not copy sheets onto which the documnet of the size read can be copied at the magnification set are contained in any one of the up-and-down type paper feeding devices 12, 13 and 14 (step S4).

If it is determined in the step S2 that the selection signal for the up-and-down type paper feeding device is applied, or it is determined in the step S4 that there are copy sheets of size reqiured, the CPU 23 determines which of the up-and-down type paper feeding devices 12, 13 and 14 contains the copy sheets, to select the up-and-down type paper feeding device 12 in the upper stage, the up-and-down type paper feeding device 13 in the middle stage, or the up-and-down type paper feeding device 14 in the lower stage (step S5).

The CPU 23 then determines, in response to the output of the paper detecting switch 17, whether or not copy sheets are disposed on the paper deck 16 in the selected up-and-down type paper feeding device. If the copy sheets are disposed, the CPU 23 then determines whether or not the paper deck 16 is raised to a position where the copy sheets can be fed (step S7). If the paper deck 16 is in the lowered position, the CPU 23 causes the paper deck 16 to be raised to a position where the copy sheets can be fed (step S8).

As described in the foregoing, the present embodiment is characterized in that it is not necessary to perform an operation, for example depress a button, so as to raise the paper deck 16 or set the paper deck 16 again when the paper deck 16 is in the lowered position. It is possible to automatically raise the paper deck 16 in response to setting of a copy mode in the main body 11 of the electrophotographic copying apparatus 10 to select any one of the up-and-down type paper feeding devices 12, 13 and 14.

As a result, no special operation for raising the paper deck 16 is required. Accordingly, the operability of the entire electrophotographic copying apparatus 10 is improved.

In the present embodiment, even if there is only one copy sheet on the paper deck 16, the paper detecting switch 17 is turned on. In the step S6, therefore, the CPU 23 determines that there is a copy sheet, to cause the paper deck 16 to be raised. In such construction, there occur circumstances where the paper deck 16 must be lowered so as to supply copy sheets immediately after it is raised when few copy sheets remain on the paper deck 16, for example, only one or several copy sheets. However, when the paper detecting switch 17 is, for example, a switch capable of determining whether or not there are copy sheets whose number is a predetermined number of more, the paper deck 16 can be automatically raised only when the number of copy sheets on the paper deck 16 is the predetermined number or more. In such construction, the above described circumstances can be avoided.

In addition, when the paper detecting switch 17 is a switch capable of detecting the number of copy sheets, the number of copies set in the main body 11 of the electrophotographic copying apparatus 10 is compared with the output of the paper detecting switch 17, and the paper deck 16 is raised only when the number of copy sheets detected by the paper detecting switch 17 is larger than the number of copies set.

Figure 5:
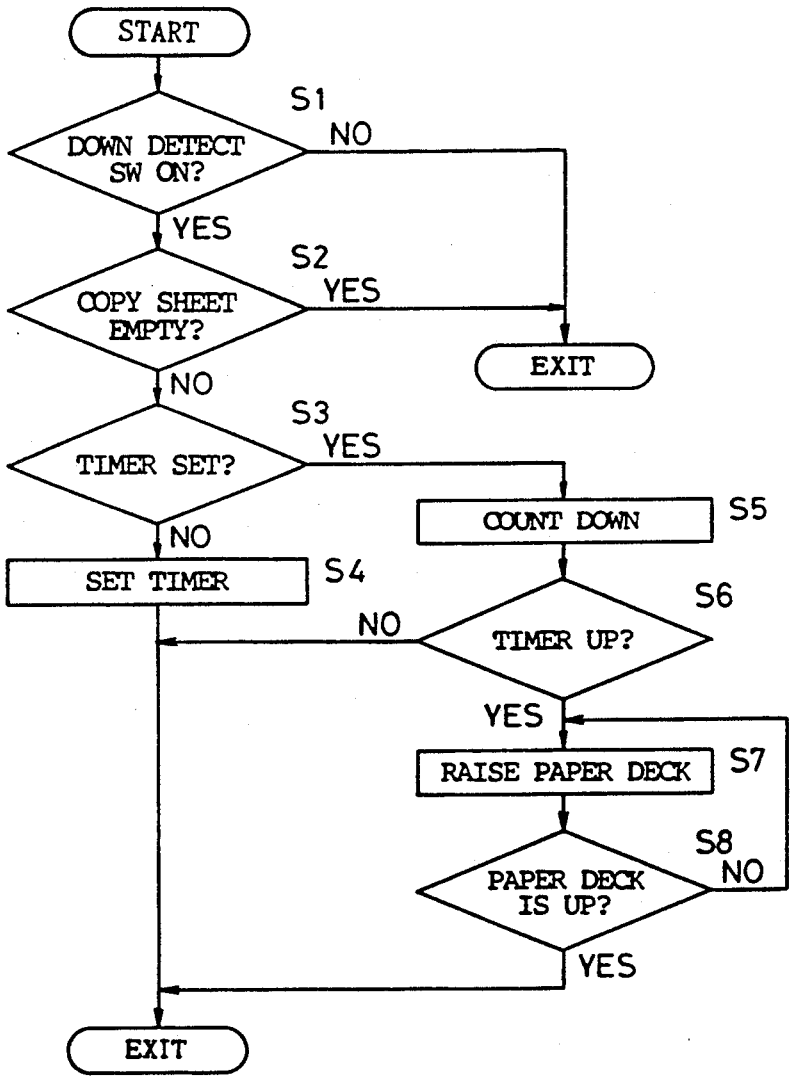
FIG. 5 is flow chart showing a control operation of an up-and-down type paper feeding device according to another embodiment of the present invention.

FIG. 5 is a flow chart for explaining a second operation of the control circuit shown in FIG. 3. This second operation corresponds to a second embodiment of the invention described in the claim 5. In FIG. 5, a control operation for the up-and-down type paper feeding device 14 is shown by way of example.

The steps of this flow chart are executed by an interruption for each constant cycle. The CPU 23 first determines whether or not the deck down detecting switch 19 is turned on (step S1). If the deck down detecting switch 19 is turned on, the paper deck 16 is in the lowered position. In such a case, therefore, the CPU 23 further determines input from the paper detecting switch 17 (step S2). If the paper detecting switch 17 is turned on and there is a copy sheet on the paper deck 16, the CPU 23 determines whether or not a timer is set (step S3). In the present embodiment, this timer is a soft timer composed of the CPU 23 and the timer area 27 in the RAM 26. If the timer is not set, the CPU 23 stores a constant count value in the timer area 27, to set the timer (step S4). Thereafter, another processing is performed.

At the time of the next interruption processing, when control of the CPU 23 proceeds to the step S3, the CPU 23 decrements the counted value stored in the timer area 27 by, for example, "1" because the timer has been already set (step S5). It is determined whether or not the counted value in the timer area 27 becomes "0", that is, the timer reaches the full count (step S6). If the timer does not reach the full count, another processing is executed.

If the timer reaches the full count in the step S6 after interruption processing is repeated many times, the CPU 23 outputs an up-and-down motor drive signal and a deck up signal to the up-and-down mechanism, to raise the paper deck 16 (step S7). The paper deck 16 is raised until the deck up detecting switch 20 is turned on, that is, the paper deck 16 enters a state where copy sheets can be fed (steps S7 and S8). In the foregoing, this control for the up-and-down type paper feeding device 14 is terminated.

Although in FIG. 5, description is made of only control for the up-and-down type paper feeding device 14, the same interruption processing is performed with respect to the other up-and-down type paper feeding devices 12 or 13.

Accordingly, when the up-and-down type paper feeding devices 12, 13 and 14 are in the lowered position and the copy sheets are disposed on the respective paper decks 16 of the paper feeding devices 12, 13 and 14, each of the paper decks 16 is automatically raised after an elapse of a constant time period, so that the up-and-down type paper feeding devices 12, 13 and 14 are brought into a state where the copy sheets can be fed.

In the present embodiment, even if there is only one copy sheet on the paper deck 16, the paper detecting switch 17 is turned on, so that the CPU 23 determines that there is a copy sheet to cause the paper deck 16 to be raised after the timer reaches the full count. In such construction, there occur circumstances where the paper deck 16 must be lowered to supply copy sheets immediately after it is raised when there remain few copy sheets on the paper deck 16, for example, only several copy sheets, so that a lot of time and labor are required. However, when the paper detecting switch 17 is, for example, a switch capable of determining whether or not there are copy sheets whose number is at least a predetermined number, the paper deck 16 can be automatically raised only when the number of copy sheets on the paper deck 16 is at least the predetermined number. In such construction, the above described time and labor can be saved.

Having described the present invention in detail with reference to the accompanying drawings, the present invention is not limited to the above described particular embodiments. For example, the invention was described taking an up-and-down type paper feeding device in an electrophotographic copying apparatus as an example. However, the invention can be also applied to an up-and-down type paper feeding device such as in a printer and a printing machine. It should be understood that various modifications may be made without departing from the scope of the present invention.

What is claimed is:

1. A paper feeding mechanism for an image forming apparatus, said paper feeding mechanism comprising a vertically extending frame member; a plurality of up-and-down paper feeding devices mounted on said frame member and being vertically aligned at a like plurality of different vertical positions, each paper feeding device including a paper deck, for holding copy sheets to be supplied to a main body of the image forming apparatus, and an up-and-down mechanism for raising and lowering the associated paper deck, independent of movement of the paper decks of any other of the plurality of paper feeding devices, between a paper-supplying position in which copy sheets disposed on said associated paper deck can be sequentially supplied to the main body of the image forming apparatus and a paper-replenishing position in which additional copy sheets can be placed on said associated paper deck, each up-and-down mechanism including:

paper detecting means for determining whether the number of copy sheets disposed on said associated paper deck is at least a predetermined number;

selection signal detecting means for detecting a selection signal from the main body of the image forming apparatus, indicative of selection of paper feeding from said associated paper deck; and control means responsive to simultaneous occurrence of a paper detection output from said paper detecting means, indicating that at least the predetermined number of copy sheets is disposed on said associated paper deck, and a selection output from said selection signal detecting means, indicating selection of paper feeding from said associated paper deck, for driving said up-and-down mechanism to position said associated paper deck at the paper-supplying position.

2. An up-and-down type paper feeding device according to claim 1, wherein said paper detecting means includes means for determining whether the number of copy sheets disposed on said associated paper deck is at least one, or not, and for providing the paper detection output if there is at least one copy sheet on said associated paper deck.

3. An up-and-down type paper feeding device according to claim 1, wherein said paper detecting means includes means for determining whether the number of copy sheets disposed on said associated paper deck is at least a predetermined plural number, or not, and for providing the paper detection output if there are at least said plural number of copy sheets on said associated paper deck.

4. An up-and-down type paper feeding device according to claim 1, wherein said paper detecting means includes means for determining the number of copy sheets disposed on said associated paper deck; means for receiving from the main body of the image forming apparatus a signal indicating a number of copies to be made; means for comparing the determined number with the indicated number; and means for providing the paper detection output only when the determined number is equal to or larger than the indicated number.

5. A paper feeding mechanism for an image forming apparatus, said paper feeding mechanism comprising a vertically extending frame member; a plurality of up-and-down paper feeding devices mounted on said frame member and being vertically aligned at a like plurality of different vertical positions, each paper feeding device including a paper deck, for holding copy sheets to be supplied to a main body of the image forming apparatus, and an up-and-down mechanism for raising and lowering the associated paper deck, independent of movement of the paper decks of any other of the plurality of paper feeding devices, between a paper-supplying position in which copy sheets disposed on said associated paper deck can be sequentially supplied to the main body of the image forming apparatus and a paper-replenishing position in which additional copy sheets can be placed on said associated paper deck, each up-and-down mechanism including:

deck position detecting means for detecting that said associated paper deck is in the paper-replenishing position;

paper detecting means for determining whether the number of copy sheets disposed on said associated paper deck is at least a predetermined number, timer means responsive to simultaneous occurrence of a deck position output from said deck position detecting means, indicating that said associated paper deck is in the paper-replenishing position, and a paper detection output from said paper detecting means, indicating that at least the predetermined number of copy sheets is disposed on said associated paper deck, for initiating timing of a predetermined time period; and control means responsive to said timer means completing timing of the predetermined time period for activating said up-and-down mechanism to bring said associated paper deck to the paper-supplying position.

6. An up-and-down type paper feeding device according to claim 5, wherein said paper detecting means includes means for determining whether the number of copy sheets disposed on said associated paper deck is at least one, or not, and for providing the paper detection output if there is at least one copy sheet on said associated paper deck.

7. An up-and-down type paper feeding device according to claim 5, wherein said paper detecting means includes means for determining whether the number of copy sheets disposed on said associated paper deck is at least a predetermined plural number, or not, and for providing the paper detection output if there are at least said plural number of copy sheets on said associated paper deck.

* * * * *